US007377708B2

(12) United States Patent
Hageman et al.

(10) Patent No.: US 7,377,708 B2
(45) Date of Patent: May 27, 2008

(54) WRITING INSTRUMENT WITH MULTI-MODE TETHERING

(75) Inventors: Christopher Hageman, Glastonbury, CT (US); James T. Sener, Glastonbury, CT (US)

(73) Assignee: Pentel of America, Ltd., Torrance, CA (US)

( * ) Notice: Subject to any disclaimer, the term of this patent is extended or adjusted under 35 U.S.C. 154(b) by 428 days.

(21) Appl. No.: 11/209,148

(22) Filed: Aug. 22, 2005

(65) Prior Publication Data

US 2007/0041778 A1 Feb. 22, 2007

(51) Int. Cl.
*B43K 23/02* (2006.01)
*B43K 5/00* (2006.01)

(52) U.S. Cl. ..... 401/131; 401/202

(58) Field of Classification Search ..... 401/131, 401/98, 202, 243, 246, 247; D19/43, 44, D19/54, 57, 58
See application file for complete search history.

(56) References Cited

U.S. PATENT DOCUMENTS 1,509,255 A * 9/1924 Pollak ..... 401/63
2,476,571 A * 7/1949 Vierling ..... 401/117
5,762,435 A * 6/1998 Fukushima ..... 401/213

OTHER PUBLICATIONS http://www.bartleby.com/61/73/A0507300.html.*

* cited by examiner

*Primary Examiner*—David J Walczak
(74) *Attorney, Agent, or Firm*—Adams & Wilks

(57) ABSTRACT

A writing instrument has a main body having front and rear ends and a writing tip at the front end, and a cap detachably attachable to a front portion of the main body to cover the writing tip and detachably attachable to a rear portion of the main body. A first opening is provided in the rear portion of the main body, and a second opening is provided in the cap. The first and second openings are alignable with one another when the cap is detachably attached to the rear portion of the main body to enable a tether to be threaded through the aligned openings for tethering the writing instrument to an object. Alternatively, the tether may be threaded through only the first opening at the rear portion of the main body for tethering the main body to an object. The cap may have a third opening at or near an end thereof, and the tether may alternatively be threaded through the third opening for tethering the cap to an object. This multi-mode tethering greatly increases the versatility of the writing instrument, enabling it to be attached to objects in different ways.

22 Claims, 6 Drawing Sheets

WRITING INSTRUMENT WITH MULTI-MODE TETHERING

BACKGROUND OF THE INVENTION

The present invention relates generally to writing instruments that can be tethered to an object, such as a person, clipboard, knapsack and the like, and more particularly to a writing instrument that can be tethered to an object in various modes to thereby increase the versatility of the writing instrument.

Writing instruments are generally known that have provision for a tether for tethering or connecting the writing instrument to an object. These writing instruments typically have an opening at the rear end thereof for receiving a tether, which may be fixed or slidable in the opening.

Such writing instruments have the drawback that they may be tethered in only one mode, i.e., through the opening provided at the rear end of the writing instrument. Another drawback is that when the cap is removed to enable use of the writing instrument, the cap is likely to be misplaced since though the main body of the writing instrument is tethered, the cap is not. If left uncapped for long periods, the performance of the writing instrument may deteriorate.

SUMMARY OF THE INVENTION

An object of the present invention is to provide a writing instrument that overcomes the drawbacks of the prior art writing instruments.

Another object of the present invention is to provide a writing instrument that can be tethered in different modes and which therefore has enhanced versatility.

A further object of the present invention is to provide a writing instrument in which either the cap or the main body of the writing instrument can be tethered when the writing instrument is not in use, and in which both the cap and the main body can be tethered when the writing instrument is in use.

A still further object of the present invention is to provide a writing instrument that can be tethered in different modes and which has a simple design that enables it to be easily alternatively tethered in any one of the different modes.

The foregoing as well as other objects of the present invention are realized by a writing instrument comprising a main body having front and rear ends and a writing tip at the front end, and a cap detachably attachable to a front portion of the main body to cover the writing tip and detachably attachable to a rear portion of the main body. A first opening is provided in the rear portion of the main body, and a second opening is provided in the cap. The first and second openings are alignable with one another when the cap is detachably attached to the rear portion of the main body to enable a tether to be threaded through the aligned openings for tethering the writing instrument to an object. Alternatively, the tether may be threaded through only the first opening at the rear portion of the main body for tethering the main body to an object. The cap may have a third opening at or near an end thereof, and the tether may alternatively be threaded through the third opening for tethering the cap to an object.

By such an arrangement, the writing instrument may, in a first mode, be tethered from the cap so that the main body can be detached from the cap for use and re-attached to the cap after use. Alternatively, in a second mode, the writing instrument may be tethered from the rear end of the main body, with or without the cap in place. In a third mode, with the cap attached to the rear end of the main body, the writing instrument may be tethered from both the cap and the main body. This multi-mode tethering greatly increases the versatility of the writing instrument, enabling it to be attached to objects in different ways.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, the drawings show several presently preferred embodiments. It should be understood, however, that the invention is not limited to these embodiments, or to the precise arrangements and instrumentalities shown. In the drawings.

DETAILED DESCRIPTION OF THE PREFERRED EMBODIMENTS

While the present invention is susceptible of embodiments in many different forms, this specification and the accompanying drawings disclose only some forms as examples of the use of the invention. The invention is not intended to be limited to the examples so described, and the scope of the invention is set forth in the appended claims.

As used herein, the term "tether" means and includes a flexible length of material such as a cord, lanyard, chain, ribbon, wire, etc. attachable to a writing instrument to restrict or limit the range of movement of the writing instrument relative to an object. The tether may be in the form of a closed, endless loop which may, for example, be worn around the neck of a person or threaded through an opening in a clipboard, knapsack and the like. The tether may also be in the form of a length of a material that can be connected at one end to the writing instrument and connected at another end to an object, such as a desk, work surface and the like. The tether may be constructed of any suitable flexible material, may be decorative or plain, and may have any desired cross-sectional shape and size, the only limitation being that the tether fit through openings in the writing instrument to enable the writing instrument to be tethered to an object.

As used herein, the term "writing instrument" means and includes all types of writing instruments that have caps, such as pens, markers, highlighters and the like regardless of the particular type of writing medium.

As used herein with reference to tethering a writing instrument to an object, the term "object" is used in its broadest sense and means and includes any object to which a writing instrument could be attached, such as a person, clipboard, zipper, knapsack, work station, clothing, belt, buttonhole, etc.

Figure 1:
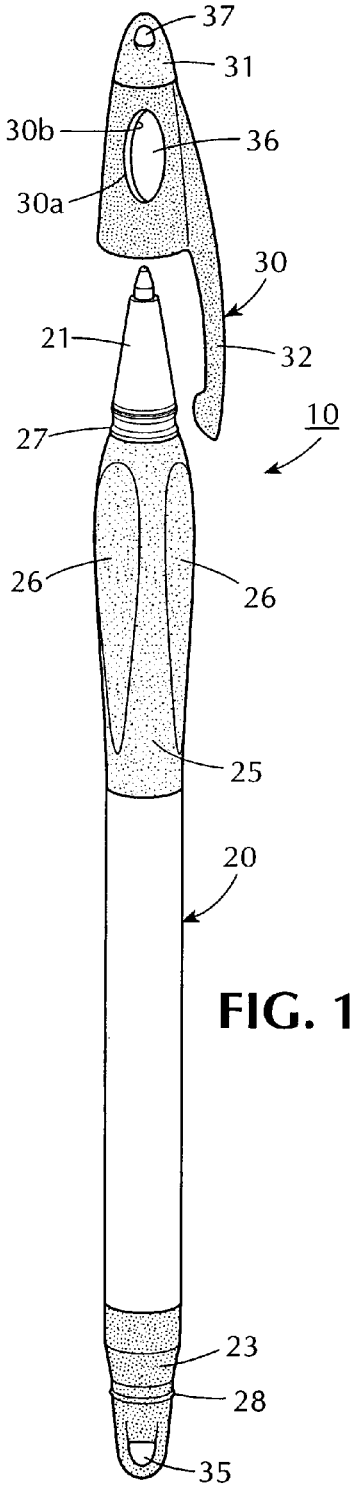
FIG. 1 is a front view of a writing instrument constructed according to the principles of the present invention, with the cap removed from the writing tip of the main body.
Figure 2:
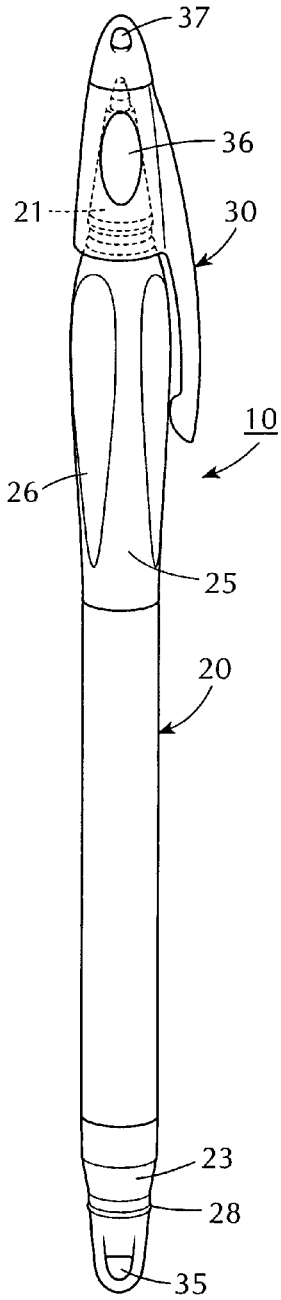
FIG. 2 is a front view of the writing instrument with the cap attached to the main body and covering the writing tip.
Figure 3:
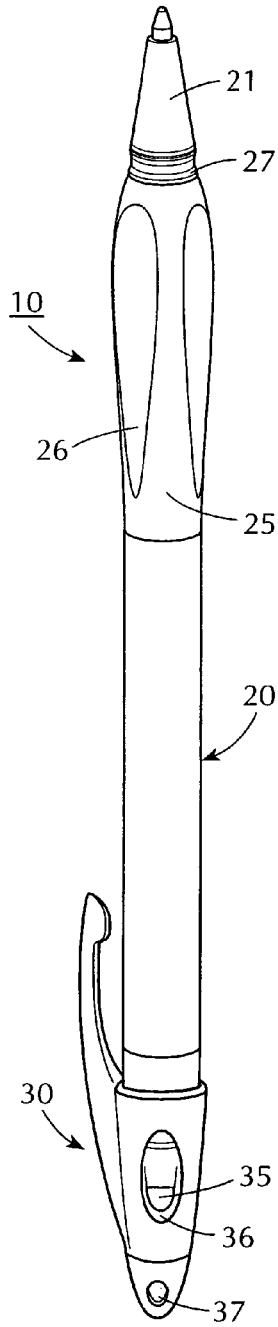
FIG. 3 is a front view of the writing instrument showing the cap attached to the rear end of the main body.

Referring to the drawings, wherein like reference numerals are used to indicate like elements throughout, there is shown in FIGS. 1-3 a writing instrument 10 constructed according to the principles of the present invention. For illustrative purposes only, the writing instrument 10 shown in the drawings is a ball point pen; however, as stated above, the invention is not limited to this type of writing instrument and is applicable to any writing instrument that has a main body and a cap.

The writing instrument 10 has a main body 20 and a removable cap 30. The main body 20 has a tubular shape and opposite front and rear ends. A writing tip 21 is connected to the front end of the main body 20 for dispensing a writing medium contained within the main body 20. In the case of a ball point pen, the writing medium is ink supplied from an ink source housed within the main body 20. A rear end plug 23 is connected to and closes the rear end of the main body 20. To facilitate use of the writing instrument 10 and to reduce writer fatigue, the main body 20 is provided near its front end with a grip 25. In this embodiment, by way of example, the grip 25 has a set of three generally flat gripping surfaces 26 which are conveniently shaped and positioned to be gripped by the fingers of a person using the pen. The flat surfaces 26 are preferably dimpled or knurled to increase the comfortability of the grip and to reduce slippage.

The cap 30 also has a tubular shape and has an open end and a closed end. The cap 30 is configured to fit over both the front end (FIG. 2) and the rear end (FIG. 3) of the main body 20. In this embodiment, an end plug 31 is provided to close one end of the cap, though the cap 30 may be of one-piece construction as well known in the art. A clip 32 is provided on the cap 30 for clipping the writing instrument 10 to a shirt pocket or the like.

The cap 30 is configured to be detachably attachable to both the front end and the rear end of the main body 20, preferably by means of a snap fit. For this purpose, the front end portion of the main body 20 is provided with a protrusion 27 extending circumferentially around the main body. A similar protrusion 28 extends circumferentially around the rear end portion of the main body 20. The cap 30 is provided on its inner or inside surface with one or more projections (not shown) that frictionally slide over and releasably engage with the protrusions 27 or 28 when the cap is inserted over the front end or the rear end of the main body 20 to detachably attach the cap 30 to the front and rear ends, respectively, of the main body 20. FIG. 2 shows the cap 30 detachably attached to the front portion of the main body 20, which defines the non-use state of the writing instrument, and FIG. 3 shows the cap 30 attached to the rear portion of the main body 20, which defines the use state of the writing instrument.

The main body 20 and the cap 30 are preferably molded of plastic material, and the grip 26 is preferably formed of rubber molded onto the plastic main body 20. The writing instrument is not, of course, limited to being formed of plastic material and may be formed of metal or any other suitable material, or a combination of materials, as well known in the art of writing instruments. Similarly, the grip 26 may be formed of plastic or other suitable material known in the art.

To enable the writing instrument to be tethered in different modes, a set of openings are provided at prescribed locations in the main body and the cap. More specifically, a first opening 35 is formed at or near the rear end of the main body 20. In this embodiment, the first opening 35 is formed at the rear end of the plug 23. A second elongate opening 36, which is substantially larger than the first opening 35, is formed in the cap 30, generally at the mid-portion thereof where the cap has a tubular shape. A third opening 37 is formed at or near the closed end of the cap. In this embodiment, the third opening 37 is formed at the end tip of the plug 31. The openings 35, 36 and 37 are through-openings that extend completely through the main body and the cap. The openings 35 and 37 in the plugs 23 and 31 are in the nature of eyelets. The larger opening 36 formed at the tubular mid-portion of the cap 30 extends through opposed sidewall portions 30*a*, 30*b* of the cap as best seen in FIG. 1.

Figure 4:
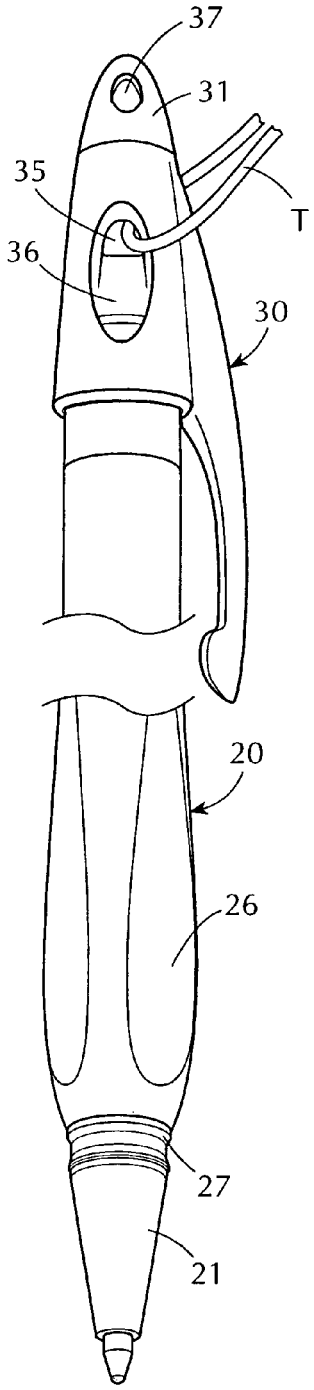
FIG. 4 is an enlarged, partly broken, front view of the writing instrument showing another tethering mode in which the tether extends through aligned openings in both the cap and the main body.

The different tethering modes of the writing instrument will now be described with reference to FIGS. 4-6. FIG. 4 shows one tethering mode of the writing instrument 10 in the use state, wherein the cap 30 is detachably attached to the rear end portion of the main body 20. In this state, the cap 30 is angularly displaceable relative to the main body 20 about the longitudinal axis of the writing instrument 10 to enable the first opening 35 in the main body 20 to be aligned with the second opening 36 in the cap 30. Alternatively, the alignment of the two openings 35 and 36 may be made prior to attachment of the cap 30 onto the rear end portion of the main body 20. A tether T is then inserted or threaded through both openings 35 and 36 to enable the writing instrument 10, i.e., the main body and the cap, to be tethered to an object.

As shown in FIG. 4, the second opening 36 is located at the mid-portion of the cap 30 and is substantially larger in size than the first opening 35 formed at the rear end of the main body 20. This enables the tether T to be easily threaded through the two openings and permits the writing instrument 10 to undergo freedom of movement relative to the tether T to facilitate use of the tethered writing instrument.

Figure 5:
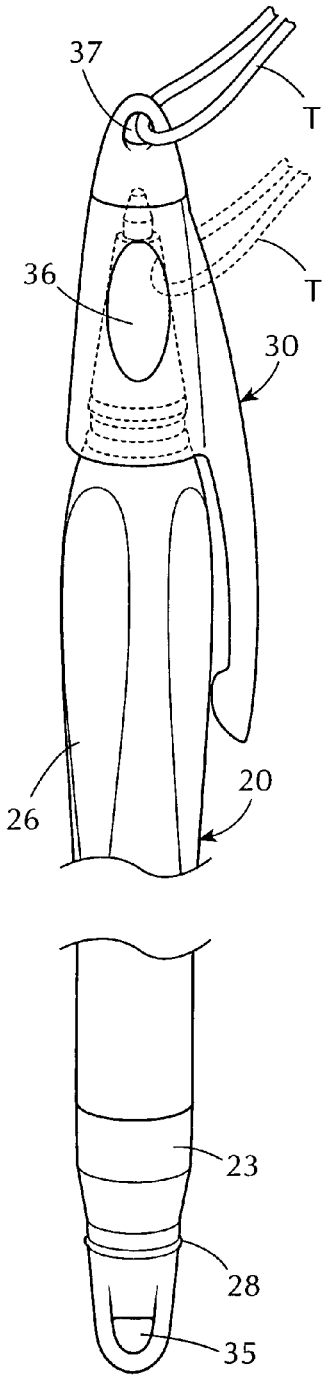
FIG. 5 is an enlarged, partly broken, front view of the writing instrument showing another tethering mode in which the tether extends through an opening at an end of the cap.

FIG. 5 shows another mode of tethering the writing instrument 10 in which the writing instrument is in the non-use state and the cap 30 is disposed over the writing tip 21 and detachably engaged with the main body 20. In this mode, the tether T is inserted or threaded through the third opening 37 thereby enabling the cap 30 to be tethered to an object. To use the writing instrument 10, the user detaches the main body 20 from the cap 30 so that the writing instrument can be used while the cap remains tethered. This prevents inadvertent misplacement of the cap and serves as a reminder to the user to the recap the writing instrument upon completion of writing.

In an alternative tethering mode shown by dashed lines in FIG. 5, the cap 30 of the writing instrument 10 may be tethered to an object by inserting or threading the tether T through the second opening 36 formed in the cap 30. This tethering mode is applicable in cases where the tether T is small or thin enough to fit through the second opening 36 when the cap 30 is attached to the front end of the main body 20 so that sufficient clearance exists around the exterior of the front end of the main body 20 to enable the tether T to be inserted or threaded through the opening on one sidewall 30*a* of the cap 30 and around the exterior of the front end of the main body 20 and then out through the opening on the other sidewall 30*b* of the cap.

Figure 6:
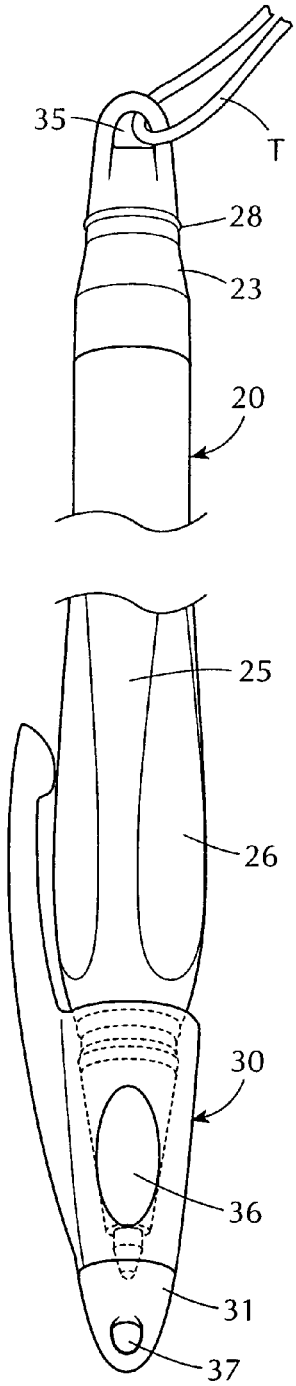
FIG. 6 is enlarged, partly broken, front view of the writing instrument showing a third tethering mode in which the tether extends through an opening at the rear end of the main body.

FIG. 6 shows another tethering mode of the writing instrument 10 in the nonuse state, wherein the cap 30 is disposed over the writing tip 21 and detachably engaged with the main body 20. In this mode, the tether T is inserted or threaded through the first opening 35 at the end of the body 20 and tethered to an object. To use the writing instrument, the user detaches the cap 30 from the main body 20 and during use, the main body 20 remains tethered to the object.

Figure 7:
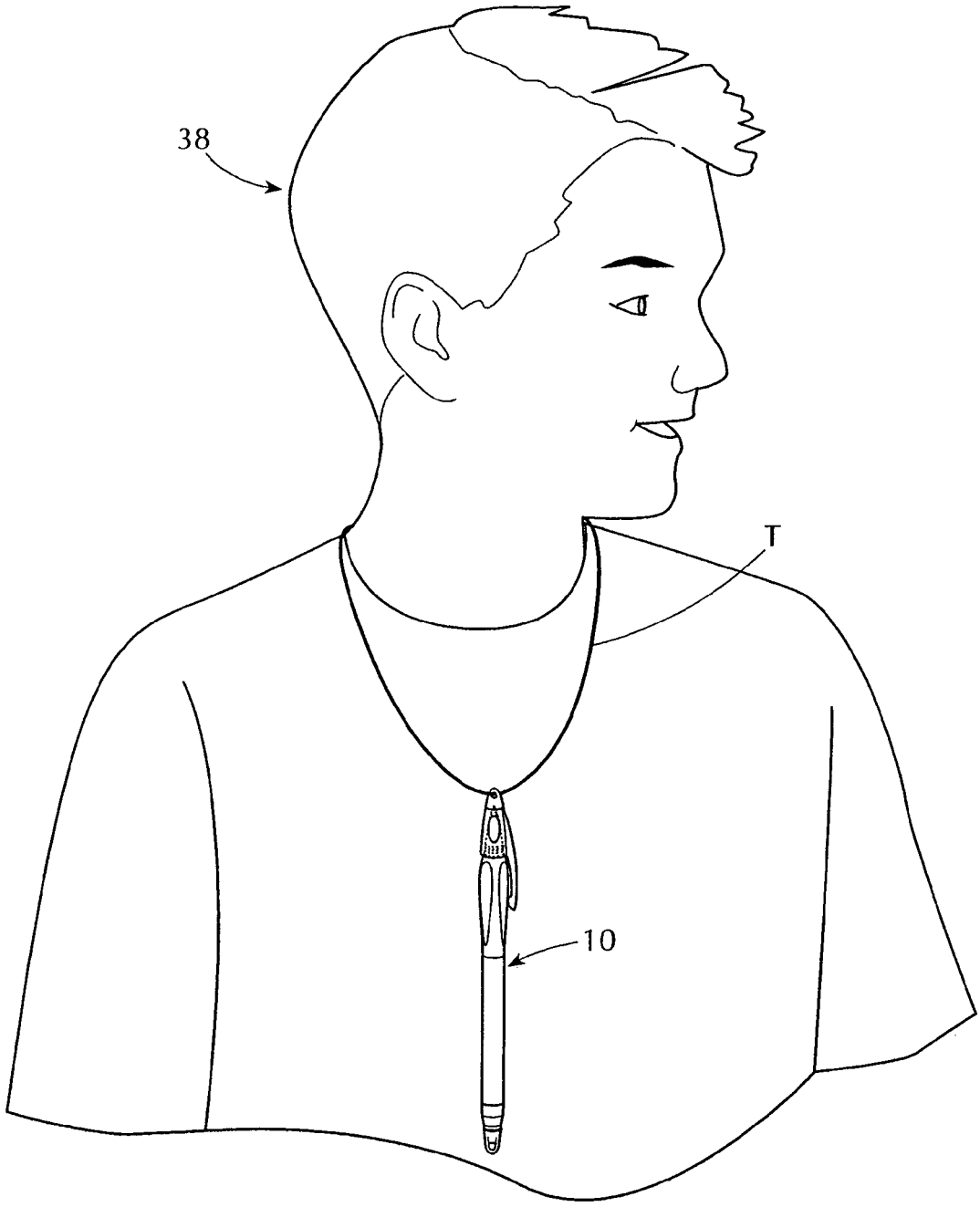
FIG. 7 is an illustrative view showing an example of the writing instrument tethered around the neck of a person.

One illustrative example of the tethering mode shown in FIG. 5 is shown in FIG. 7, which shows the writing instrument 10 tethered to a person 38. In this example, the tether T is in the form of a closed loop worn around the neck of the person.

Figure 8:
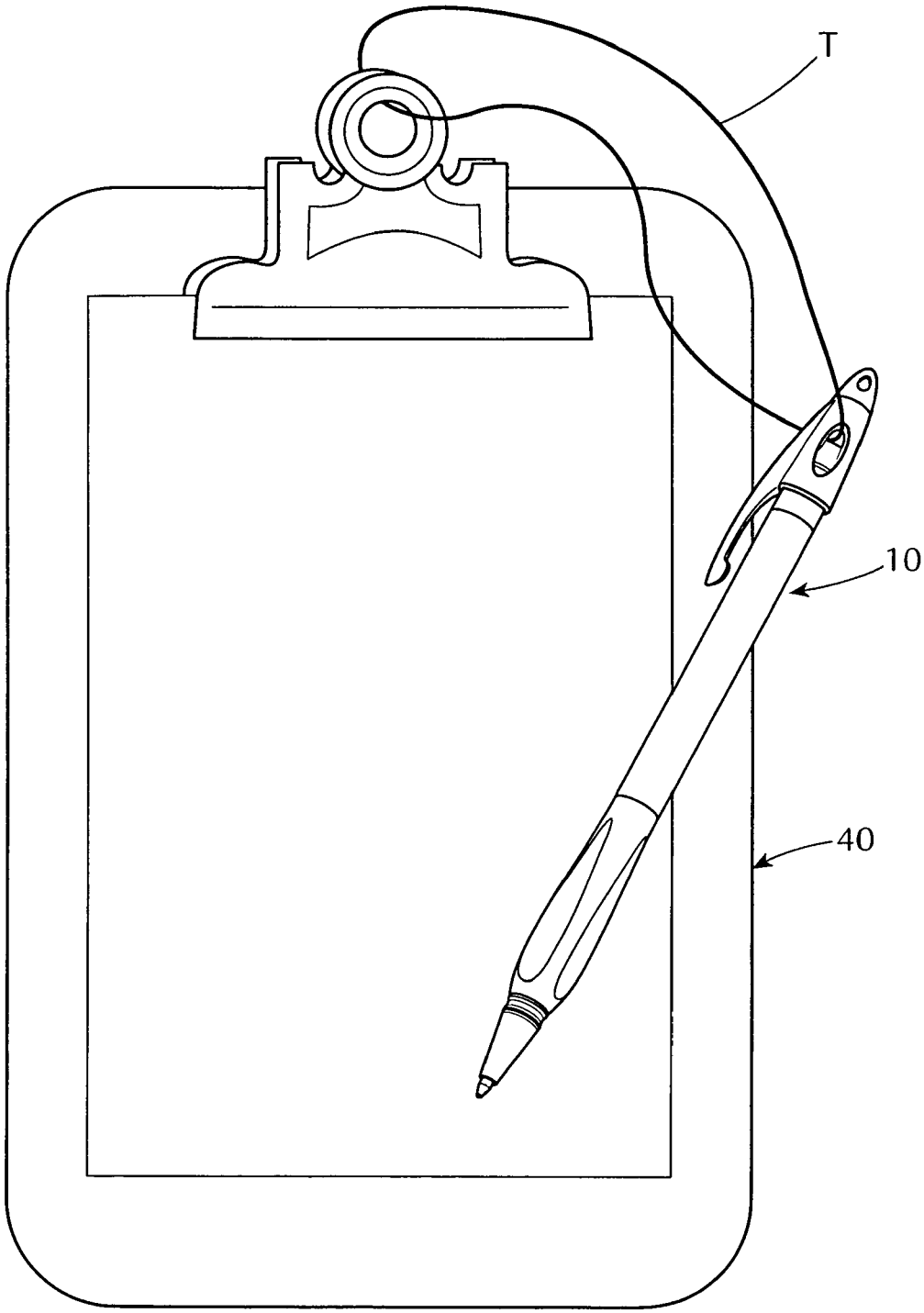
FIG. 8 is an illustrative view showing an example of the writing instrument tethered to a clipboard.
Figure 9:
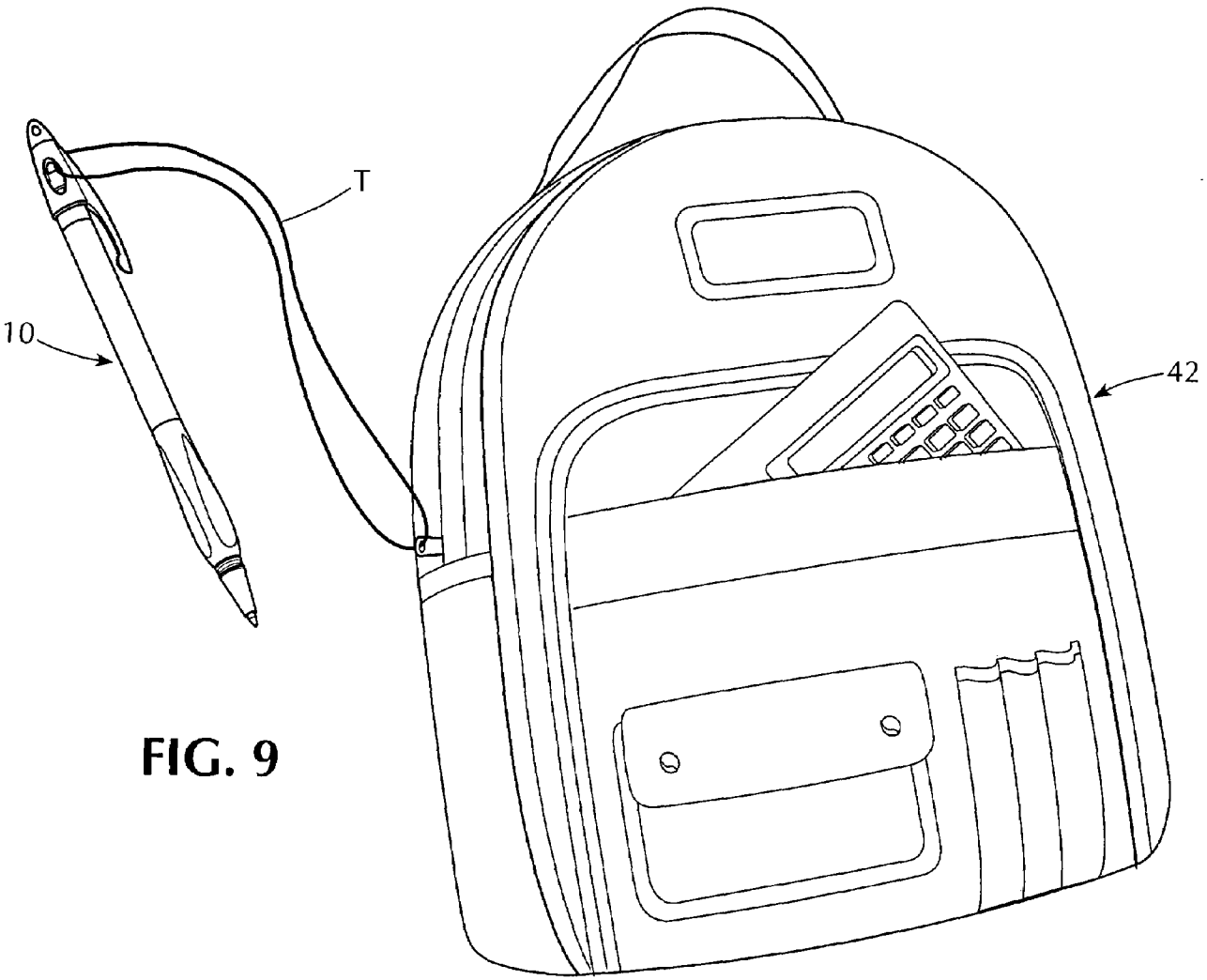
FIG. 9 is an illustrative view showing an example of the writing instrument tethered to a knapsack.
Figure 10:
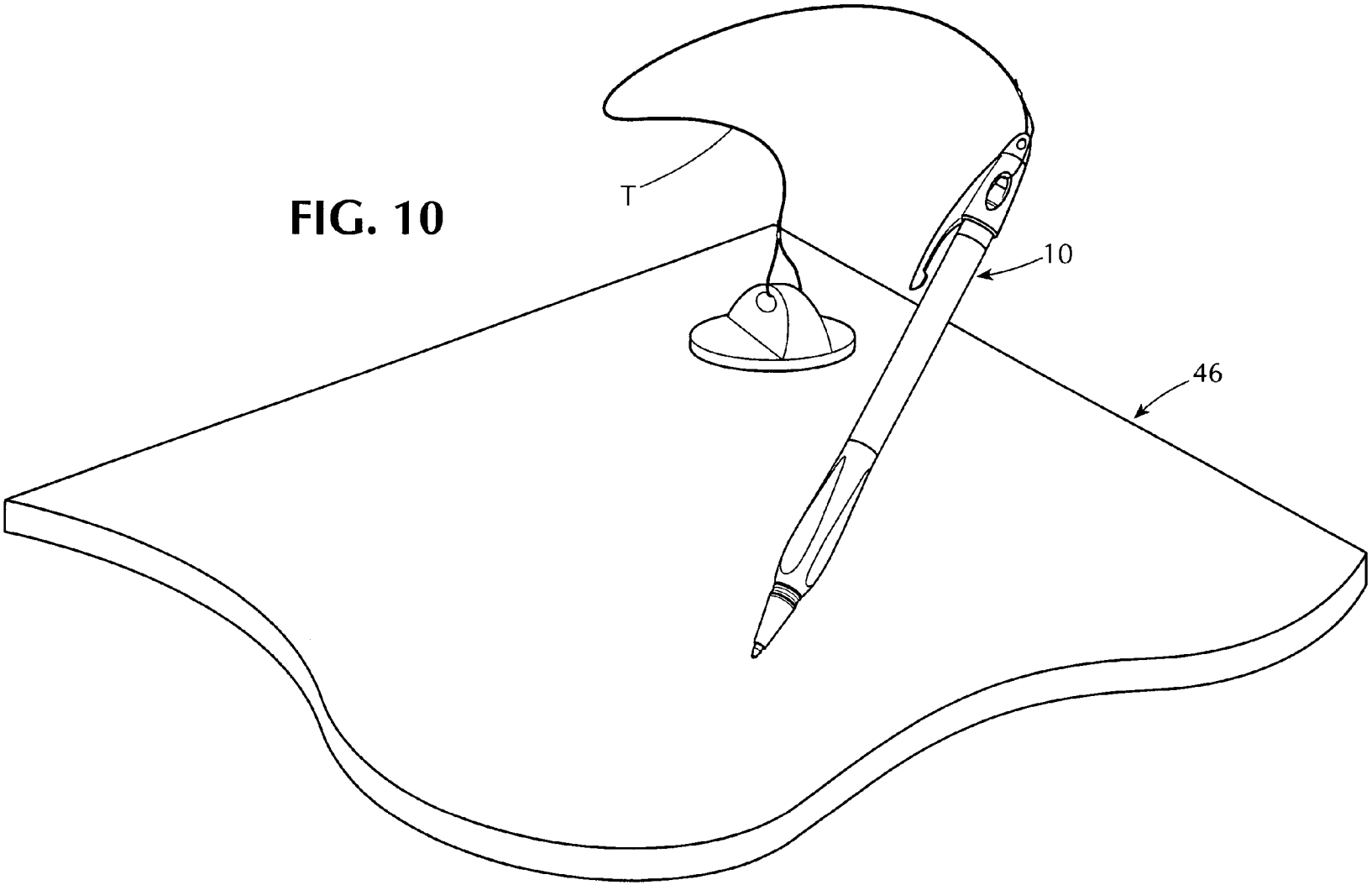
FIG. 10 is an illustrative view showing an example of the writing instrument tethered to a work surface.

Other examples illustrating the versatility of the writing instrument 10 are shown in FIGS. 8-10. In each of FIGS. 8-10, the writing instrument 10 is tethered using the tethering mode shown in FIG. 4 in which the cap 30 is detachably attached to the rear end of the main body 20 and the tether T extends through the aligned first opening 35 in the main body 20 and the second opening 36 in the cap 30. In FIG. 8, the writing instrument 10 is tethered by a closed-loop tether T to a clipboard 40. In FIG. 9, the writing instrument 10 is tethered by a closed-loop tether T to a zipper of a knapsack 42. In FIG. 10, the writing instrument 10 is tethered by a length of tether T to a holder on a work surface 46, such as a bank teller station. These examples are illustrative only, and the writing instrument 10 according to the present invention may be tethered to any desired object.

In one preferred embodiment, the grip 26 and the end plug 31 at the tip of the cap 30 are formed of the same first color, and the remainder of the cap 30 and the end plug 23 of the main body 20 are formed of the same second color, the first and second colors being different from one another. This is illustrated in FIG. 1 wherein the light stippling denotes the first color and the dense stippling denotes the second color. The color of the writing medium, for example, the color of the ink in the case of a ball point pen, is preferably the same as the second color, so that the user can readily ascertain the color of the writing medium from the color of the cap 30 and the end plug 23.

The multi-mode tethering capabilities of the writing instrument 10 make it ideally suited for use by medical personnel, office workers, hospitality staff, coaches and referees, flight attendants, teachers and others who require ready-access to a writing instrument.

Obvious changes and modifications to the writing instrument will become apparent to those of ordinary skill in the art, and the present invention is intended to cover all such changes and modifications that fall within the scope and spirit of the appended claims.

We claim:

1. A writing instrument comprising: a main body having a writing tip at a front end thereof; and a cap detachably attachable to a front portion of the main body to cover the writing tip and detachably attachable to a rear portion of the main body; wherein the rear portion of the main body has a first opening and the cap has a second opening, the first and second openings being alignable with one another when the cap is detachably attached to the rear portion of the main body to enable a tether to be inserted through both openings for tethering the writing instrument to an object.

2. A writing instrument according to claim 1; wherein the first opening is at or near a rear end of the main body.

3. A writing instrument according to claim 1; wherein the first opening is at a rear end of the main body.

4. A writing instrument according to claim 1; wherein the second opening is at a mid-portion of the cap.

5. A writing instrument according to claim 1; wherein the second opening extends through opposed sidewall portions of the cap.

6. A writing instrument according to claim 5; wherein the second opening has an elongate shape and is larger than the first opening.

7. A writing instrument according to claim 1; wherein the cap is angularly displaceable relative to the main body when the cap is detachably attached to the rear portion of the main body to enable the first and second openings to be brought into alignment with one another.

8. A writing instrument according to claim 1; wherein the cap has a third opening at or near an end thereof to enable a tether to be inserted therethrough for tethering the cap to an object.

9. In combination: a writing instrument comprising a main body having a writing tip at a front end thereof and a first opening at or near a rear end thereof, and a cap having a second opening and being disposable over the writing tip for detachably engaging with the main body to define a non-use state of the writing instrument and disposable over the rear end of the main body for detachably engaging with the main body to define a use state of the writing instrument; and a tether alternatively threadable through the first opening for tethering the main body to an object and through both the first and second openings when the writing instrument is in the use state for tethering both the main body and the cap to an object.

10. A combination according to claim 9; wherein the first opening is at the rear end of the main body.

11. A combination according to claim 9; wherein the second opening is at a mid-portion of the cap.

12. A combination according to claim 9; wherein the second opening extends through opposed sidewall portions of the cap.

13. A combination according to claim 12; wherein the second opening has an elongate shape and is larger than the first opening.

14. A combination according to claim 9; wherein the cap is angularly displaceable relative to the main body when the cap is detachably attached to the rear portion of the main body to enable the first and second openings to be brought into alignment with one another to enable the tether to be threaded through both the first and second openings.

15. A combination according to claim 9; wherein the cap has a third opening at or near an end thereof; and the tether is alternatively threadable through the third opening for tethering the cap to an object.

16. A combination according to claim 15; wherein the tether is dimensioned relative to the writing instrument to enable the tether to be threaded through the second opening when the writing instrument is in the non-use state for tethering the cap to an object.

17. A combination according to claim 9; wherein the tether is dimensioned relative to the writing instrument to enable the tether to be threaded through the second opening when the writing instrument is in the non-use state for tethering the cap to an object.

18. A combination according to claim 9; wherein the writing instrument is a pen having ink of a given color, and the cap except for an end tip thereof is the same color as the ink.

19. A combination according to claim 18; wherein the rear end of the main body terminates in an end plug that is the same color as the cap except for the end tip thereof.

20. A combination according to claim 19; wherein the main body has a grip portion of a different color from the given color, and the end tip of the cap is the same color as the grip portion.

21. A combination according to claim 9; wherein the cap is detachably engageable with the main body at front and rear end portions thereof with a snap fit.

22. A writing instrument according to claim 1; wherein the cap is detachably attachable to the front and rear portions of the main body with a snap fit.

* * * * *